US009211542B2

(12) United States Patent
Urban et al.

(10) Patent No.: US 9,211,542 B2
(45) Date of Patent: Dec. 15, 2015

(54) HIGH-DENSITY SAMPLE SUPPORT PLATE FOR AUTOMATED SAMPLE ALIQUOTING

(75) Inventors: Pawel Urban, Rzeszow (PL); Renato Zenobi, Zürich (CH); Konstantins Jefimovs, Tegerfelden (CH); Andrea Amantonico, Carouge (CH); Stephan Fagerer, Zürich (CH); Nils Goedecke, Zürich (CH)

(73) Assignees: EIDGENOSSISCHE TECHNISCHE HOCHSCHULE ZURICH, Zurich (CH); EMPA EIDG. MATERIALPRUFUNGS—UND FORSCHUNGSANSTALT, Dubendorf (CH)

( * ) Notice: Subject to any disclaimer, the term of this patent is extended or adjusted under 35 U.S.C. 154(b) by 0 days.

(21) Appl. No.: 13/699,446

(22) PCT Filed: May 20, 2011

(86) PCT No.: PCT/EP2011/058273

§ 371 (c)(1), (2), (4) Date: Feb. 1, 2013

(87) PCT Pub. No.: WO2011/144743

PCT Pub. Date: Nov. 24, 2011

(65) Prior Publication Data

US 2013/0146758 A1 Jun. 13, 2013

(30) Foreign Application Priority Data

May 21, 2010 (EP) ..... 10163610

(51) Int. Cl.
*H01J 49/00* (2006.01)
*B01L 9/00* (2006.01)
(Continued)

(52) U.S. Cl.
CPC . *B01L 9/00* (2013.01); *B05D 3/007* (2013.01); *H01J 49/0418* (2013.01); *H01J 49/161* (2013.01); *H01J 49/26* (2013.01)

(58) Field of Classification Search
CPC ..... H01J 49/00; H01J 49/02; H01J 49/0463; H01J 49/0431; H01J 49/0409; H01J 49/0418; H01J 49/0436
USPC ..... 250/281, 282, 288
See application file for complete search history.

(56) References Cited

U.S. PATENT DOCUMENTS 6,287,872 B1 9/2001 Schurenberg et al.
7,619,215 B2 11/2009 Kim
(Continued)

FOREIGN PATENT DOCUMENTS

DE 19923761 C1 2/2001
EP 1284495 A2 2/2003

OTHER PUBLICATIONS

Amantonico, Andrea et al., "Mass Spectrometric Method for Analyzing Metabolites in Yeast with Single Cell Sensitivity", Analytical Methods, Angewandte Chemie, No. 120, pp. 5462-5465, 2008.
(Continued)

*Primary Examiner* — Michael Logie
*Assistant Examiner* — Jason McCormack
(74) *Attorney, Agent, or Firm* — Browdy and Neimark, PLLC

(57) ABSTRACT

A sample support plate (100) for a variety of possible applications, including MALDI mass spectrometry, is disclosed. A plurality of spatially separated sample recipient sites (101) are arranged on the surface of a substrate. The recipient sites are mutually separated by areas having a different wettability than the recipient sites. They are arranged in a plurality of rows consisting of a plurality of recipient sites whose centers are regularly spaced along a first direction with a predetermined periodicity (D1), the rows being regularly spaced along a second direction perpendicular to the first direction with a predetermined centerline distance (D2). Each recipient site has a maximum lateral dimension that is preferably smaller than the diameter of a beam spot (104) of a desorption laser beam (103). In order to enable unsupervised splitting of bulk liquid samples into droplets at the sample recipient sites, the periodicity along the first direction and the centerline distance along the second direction are chosen such that each recipient sites has a next neighbor at a distance that is less than or equal to three times the minimum lateral dimension of each recipient site. In preferred embodiments, the sample recipient sites are arranged in a checkerboard-type pattern or in rows that are inclined relative to the edges of the sample support plate.

10 Claims, 15 Drawing Sheets

(51) Int. Cl.

| | |
|---|---|
| ***H01J 49/04*** | (2006.01) |
| ***H01J 49/16*** | (2006.01) |
| ***B05D 3/00*** | (2006.01) |
| ***H01J 49/26*** | (2006.01) |

(56) References Cited

U.S. PATENT DOCUMENTS

| | | | | |
|---|---|---|---|---|
| 2002/0051738 | A1* | 5/2002 | Schurenberg et al. | 422/102 |
| 2003/0025074 | A1* | 2/2003 | Li | 250/288 |
| 2003/0057368 | A1* | 3/2003 | Franzen et al. | 250/281 |
| 2003/0072684 | A1* | 4/2003 | Anderson et al. | 422/100 |
| 2003/0213905 | A1* | 11/2003 | Lennon et al. | 250/288 |
| 2003/0213906 | A1* | 11/2003 | Lennon et al. | 250/288 |
| 2004/0241834 | A1* | 12/2004 | James | 435/287.2 |
| 2004/0258832 | A1 | 12/2004 | Barklund et al. | |
| 2005/0072917 | A1* | 4/2005 | Becker | 250/288 |
| 2005/0153344 | A1* | 7/2005 | Diamond et al. | 435/6 |
| 2006/0016984 | A1* | 1/2006 | Finch et al. | 250/288 |
| 2006/0121599 | A1* | 6/2006 | Reihs | 435/287.1 |
| 2007/0075241 | A1* | 4/2007 | Kim | 250/284 |
| 2008/0179513 | A1* | 7/2008 | Laprade et al. | 250/288 |
| 2009/0075837 | A1* | 3/2009 | Burke et al. | 506/12 |
| 2010/0176288 | A1* | 7/2010 | Barnes et al. | 250/282 |

OTHER PUBLICATIONS

Amantonico, Andrea et al., "Facile analysis of metabolites by capillary electrophoresis coupled to matrixassisted laser desorption/ionization mass spectrometry using target plates with polysilazane nanocoating and grooves", Analyst, The Royal Society of Chemistry, No. 134, pp. 1536-1540, 2009.

Ekstrom, Simon et al., "Disposable polymeric high-density nanovial arrays for matrix assisted laser desorption/ionization-time of flight-mass spectrometry: II Biological applications", Electrophoresis, No. 22, pp. 3984-3992, 2001.

Marko-Varga, Gyorgy et al., "Disposable polymeric high-density nanovial arrays for matrix assisted laser desorption/ionization-time of flight-mass spectrometry: I. Microstructure development and manufacturing", Electrophoresis, No. 22, pp. 3978-3983, 2011.

McLauchlin, Melissa et al., "Evaporative properties and pinning strength of laser-ablated hydrophilic sites on lotus-leaf-like, nanostructured surfaces", Langmuir, American Chemistry Society, No. 23, pp. 4871-4877, 2007.

Nordhoff, Eckhard et al., "Sample preparation protocols for MALDI-MS of peptides and oligonucleotides using prestructured sample supports", International Journal of Mass Spectrometry, No. 226, pp. 163-180, 2003.

Schuerenberg, Martin et al., "Prestructured MALDI-MS Sample Supports", Analytical Chemistry, American Chemical Society vol. 72, No. 15, pp. 3436-3442, 2001.

* cited by examiner (a)

(b)

(a)

(b)

(a)

(b)

(a)

(b)

(a)

(b)

(c)

HIGH-DENSITY SAMPLE SUPPORT PLATE FOR AUTOMATED SAMPLE ALIQUOTING

TECHNICAL FIELD

The present invention relates to sample support plates having a high density of sample recipient sites, and to methods of manufacturing and using such sample support plates. Such sample support plates may be employed in a variety of applications, including but not limited to MALDI mass spectrometry, emulsion PCR, singularization of cells for various analytical applications, microcrystallization of proteins etc.

PRIOR ART

For the analysis of analytes containing large molecules, in particular, biomolecules, mass spectrometry using matrix-assisted laser desorption and ionization (MALDI) has become a widely used standard method. In such methods, the analyte is dispersed in a crystalline organic matrix deposited on a sample support or on the boundary surface of such a matrix. The analyte is desorbed from the sample support and ionized by action of a desorption laser beam.

Various methods are known for applying the analyte and matrix to a sample support. In the simplest form, droplets of a solution containing the matrix and the analyte are pipetted onto a metal sample support plate. The solution wets the support plate and thus forms a sample spot whose size depends on droplet size, on the hydrophilic properties of the metal and on the properties of the solution. After the solution has dried, the sample spot consists of small matrix crystals in which analyte molecules are embedded. This however often results in an irregular distribution of analyte molecules over a relatively large spot size. As a consequence, ion yield and mass resolution fluctuate over the area of the sample spot, and the desorption laser beam must therefore normally be rastered over the sample spot in order to find "sweet spots" which provide a sufficiently high ion yield and mass resolution.

In U.S. Pat. No. 6,287,872 it has been suggested to coat the surface of the sample support plate with a highly hydrophobic coating, and to provide tiny hydrophilic sample recipient sites called "anchor areas" for the sample droplets on this hydrophobic surface. As the sample droplets are applied to the support plate, they are drawn to the hydrophilic anchor areas. Upon evaporation of the droplets, the matrix and analyte are concentrated to the anchor areas. Thereby sensitivity can be greatly improved, and the search for "sweet spots" becomes easier.

Sample support plates of this kind are commercially available under the name AnchorChip™ from Bruker Daltonik GmbH, Bremen, Germany. Typically, the anchor areas have lateral dimension in the range between 200 μm and 800 μm, with distances between anchor areas in the range of several millimeters. Typically the distance between adjacent anchor areas is more than one order of magnitude larger than the lateral dimensions of the anchor areas themselves, resulting in a relatively low density of sample recipient sites. Samples are normally applied to the anchor areas sites by pipetting droplets of the sample to each anchor area site individually. If a sample droplet is accidentally deposited midway between two anchor areas, it will generally not find its way to the next anchor area and will be wasted.

Conceptually similar sample support plates have also been disclosed in the following articles:

M. Schuerenberg, C. Luebbert, H. Eickhoff, M. Kalkum, H. Lehrach and E. Nordhoff, "Prestructured MALDI-MS sample supports", *Anal Chem* 72 (2000), pp. 3436-3442; and E. Nordhoff, M. Schuerenberg, G. Thiele, C. Luebbert, K. D. Kloeppel, D. Theiss, H. Lehrach and J. Gobom, "Sample preparation protocols for MALDI-MS of peptides and oligonucleotides using prestructured sample supports", *Int J Mass Spectrom* 226 (2003), pp. 163-180.

U.S. Pat. No. 7,619,215 discloses a MALDI sample support plate made of stainless steel, on which sampling areas with typical lateral dimensions of 1 to 5 mm are marked. The plate is coated with a hydrophobic organosilane coating. Tiny sample spots are provided in a central portion of each sampling area in which no coating is present, exposing the hydrophilic stainless steel surface of the sample support plate. The sample spots have lateral dimensions in the range of 100 μm to 1 mm. These sample spots are separated by the hydrophobic coating over distances that are typically at least an order of magnitude larger than the sample spots themselves. Also with such known sample support plates, if a sample droplet hits the area midway between two sample spots, the droplet will most likely be wasted. Therefore, such sample support plates still require exact pipetting of sample droplets to the correct spots on the sample support plate.

M. L. McLauchlin, Y. Dongqing, P. Aella, A. A. Garcia, S. T. Picraux and M. A. Hayes, "Evaporative properties and pinning strength of laser-ablated, hydrophilic sites on lotus-leaf-like, nanostructured surfaces", *Langmuir* 23 (2007), 4871-4877 discloses MALDI sample support plates having a nanostructured superhydrophobic surface on which hydrophilic sample recipient sites have been prepared by laser ablation. The sites have diameters between 250 μm and 2 mm. No particular arrangements of such sites are disclosed.

A. Amantonico, J. Y. Oh, J. Sobek, M. Heinemann and R. Zenobi, "Mass spectrometric method for analyzing metabolites in yeast with single cell sensitivity", *Angew Chem Int Ed* 47 (2008), pp. 5382-5385 shows that the amounts of metabolites corresponding to single yeast cells can be detected by MALDI-MS technique while the sample spot has a size corresponding to the focus size of the desorption laser beam in the MALDI-MS instrument. Picoliter amounts of a sample solution are pipetted onto a support plate precoated with a thin, homogeneous layer of matrix. This document does not disclose any means for concentrating the sample at predefined sample recipient sites.

A. Amantonico, P. L. Urban and R. Zenobi, "Facile analysis of metabolites by capillary electrophoresis coupled to matrix-assisted laser desorption/ionization mass spectrometry using target plates with polysilazane nanocoating and grooves", *Analyst* 134 (2009), pp. 1536-1540 discloses MALDI sample plates coated with an omniphobic polysilazane coating. These sample plates are optimized for the deposition of analytes separated by capillary electrophoresis (CE). To this end, an array of parallel grooves acting as recipients for a separation effluent received from a CE apparatus is provided. No means for concentrating the effluent at predefined, point-like sample recipient sites are disclosed.

G. Marko-Varga, S. Ekstrom, G. Heildin, J. Nilsson and T. Laurell, "Disposable polymeric high-density nanovial arrays for matrix assisted laser desorption/ionization-time of flight-mass spectrometry: I. Microstructure development and manufacturing.", *Electrophoresis* 22 (2001), pp. 3978-3983 discloses MALDI sample support plates comprising arrays of nanovials fabricated in polymer substrates. The nanovials have diameters of 300, 400 or 500 μm. To improve chemical resistance, the sample plates may be covered with a homogeneous nitrocellulose/matrix layer or with a gold film. S. Ekstrom, J. Nilsson, G. Helldin, T. Laurell, and G. Marko-Varga, "Disposable polymeric high-density nanovial arrays for matrix assisted laser desorption/ionization-time of flight-mass spectrometry: II. Biological applications.", *Electrophoresis* 22 (2001), 3984-3992 discloses applications of such sample support plates. While these prior-art documents disclose MALDI sample support plates that have an increased density of sample recipient sites as compared to more traditional sample supports, it is still necessary to exactly dispense individual sample droplets into the individual sample recipient sites.

As will be apparent from the prior art, it is technically challenging to handle small volumes of liquid samples and suspensions of cells prior to analysis by MALDI-MS. An ideal sample support should simplify the sample preparation steps and provide seamless interference-free MS readout.

Similar challenges also exist in other analytical (chemical and biological) disciplines, whenever small volumes of liquid samples, including cell suspensions, are to be distributed to well-defined sample recipient sites.

SUMMARY OF THE INVENTION

In a first aspect, it is an object of the present invention to provide a sample support plate that enables a more facile application of small amounts of liquid samples to a plurality of sample recipient sites.

The invention provides a sample support plate comprising a substrate with a substantially flat surface, a plurality of spatially separated sample recipient sites being arranged on said surface. The recipient sites are mutually separated by areas that have a different degree of wettability than said recipient sites. They are arranged in a plurality of rows, each row consisting of a plurality of recipient sites whose centers are regularly spaced along a first direction with a predetermined periodicity, the rows being regularly spaced along a second direction perpendicular to said first direction with a predetermined centerline distance. Each recipient site has a minimum lateral dimension and a maximum lateral dimension, the maximum lateral dimension being less than or equal to 200 μm, preferably between 2 μm and 100 μm. The periodicity along the first direction and the centerline distance along the second direction are chosen such that each recipient site has a next neighbor within an edge distance that is less than or equal to three times said minimum lateral dimension, preferably less than or equal to twice said minimum lateral dimension.

In this manner, a bulk liquid sample may be applied to the surface of the sample support plate such that the bulk liquid will be drawn to nearby sample recipient sites with high probability and will automatically be split into droplets accumulating at these sample recipient sites. Thereby the need of exact pipetting of the liquid sample to individual sample spots is obviated. In other words, the present invention provides a sample support plate having a micro-array of densely spaced sample recipient sites, enabling facile distribution of liquid samples (including cell suspensions) among the sample recipient sites. The sample recipient sites have dimensions in a similar range as a typical dimension of the focus of a desorption laser beam. Using such micro-arrays, there is no need to address each sample recipient site individually during sample preparation.

One possible application is MALDI mass spectrometry, and the sample support plate may be adapted for such applications. In order to be compatible with MALDI procedures, at least a surface-near region of the substrate, preferably the bulk substrate or the surface of the substrate, is preferably substantially electrically conducting in order to enable charge transport away from the sample recipient sites. The term "substantially electrically conducting" is to be understood as including all situations where the substrate is sufficiently conducting to enable charge equilibration on the timescale of a few microseconds, including situations where only the areas between the sample recipient sites are electrically conducting, while the substrate is non-conducting at the sample recipient sites themselves. The substrate is preferably a metal plate, in particular, a stainless steel plate, a metallized plastic or glass plate, in particular, a plastic or glass plate coated with a noble metal, e.g., with gold, or a plastic or glass plate coated with an electrically conducting metal oxide, e.g., indium tin oxide.

The minimum and maximum lateral dimensions of each sample recipient site may be identical (as in the case of a circular sample recipient site) or different (as in the case of most other shapes). These dimensions are to be understood as being defined to be the length of a straight line drawn to the geometric center of each sample recipient site (i.e., as diametrical dimensions). The sample recipient sites of a single sample support plate may all have identical size and shape or may have different sizes and shapes, as long as the sites all are in a similar size range. The shape may be chosen according to need and may, e.g., be circular, elliptic, quadratic, triangular, rectangular, polygonal etc.

Efficient distribution of bulk liquid samples among sample recipient sites may be improved if adjacent rows are arranged so as to be shifted with respect to each other along the first direction. In some preferred embodiments, the rows are shifted by approximately half of said periodicity. This results in a (possibly distorted) "checkerboard"-type of arrangement of the sample recipient sites. When a bulk liquid sample is applied by moving some sort of application device relative to the sample support plate along the first or second direction, such a pattern increases the probability that the sample will be homogeneously distributed among adjacent sample recipient sites.

Often the sample support plate will have a substantially rectangular shape with two parallel longitudinal edges and two parallel transverse edges. Independently of the shape of the sample support plate, the sample recipient sites may be arranged in at least one array of substantially rectangular shape with two parallel longitudinal array edges and two parallel transverse array edges. The rows of sample recipient sites may then generally have an arbitrary orientation relative to the edges of the sample support plate and relative to the array edges.

In some embodiments, it may be preferred if the longitudinal edges of the sample support plate are parallel to the first direction and if the transverse edges are parallel to the second direction. If the recipient sites are arranged in a rectangular array, it may be preferred if the longitudinal array edges are parallel to the first direction and if the transverse array edges are parallel to the second direction. Either of these measures enables efficient usage of the sample recipient sites and simplifies distribution of a bulk liquid containing the sample onto the sample support if the liquid is applied by moving an application device along one of the edges of the sample support plate or of the array, respectively.

In other embodiments, the rows may have an angled orientation relative to the longitudinal edges of the sample support plate. The sample recipient sites may then form at least one array. The orientation of the rows is then preferably chosen such that, if a straight line is drawn parallel to the longitudinal edges and at an arbitrary position along the transverse edges of the sample support plate within the array, there are a plurality of sample recipient sites, preferably at least three or four sample recipient sites, which are cut by said straight line. This enables efficient and homogeneous spreading if a bulk liquid sample is applied by moving some sort of application device relative to the sample support plate along the longitudinal edge of the sample support plate, without the possibility that the application device would not move over any sample recipient site at all.

The centerline distance between adjacent rows and the periodicity within the rows preferably generally have a ratio between 0.3 and 3.0. In particular, if adjacent rows are shifted with respect to each other along the first direction by approximately half of the periodicity, it is preferred if this ratio is between 0.3 and 1.0. In particular, a ratio of 0.5 then corresponds to a "true", undistorted checkerboard-type arrangement. A ratio of $\sqrt{3}/2 \approx 0.87$ corresponds to a trigonal arrangement wherein adjacent sample recipient sites form equilateral triangles. These values are particularly preferred. In preferred embodiments, the distance from any point within the array of sample recipient sites to the edge of the closest sample recipient site is less than 1.5 times the minimum lateral dimension of each sample recipient site, preferably less than this lateral dimension itself. In terms of absolute numbers, this distance is preferably less than 300 μm, in particularly preferred embodiments, less than 100 μm, so as to ensure that droplets will find their way to the closest sample recipient site with high probability. The edge distance from each sample recipient site to the closest adjacent sample recipient site (the next neighbor) is, in absolute numbers, consequently preferably less than 600 μm, in particularly preferred embodiments, less than 200 μm.

As already stated above, the areas between sample recipient sites generally have a different wettability than the sample recipient sites themselves. The wettability of these areas for a selected solvent is preferably lower than the wettability of the sample recipient sites. In particular, for a polar solvent, this situation is normally referred to by saying that the areas between the recipient sites are more hydrophobic than the recipient sites. For a nonpolar solvent, this situation is normally referred to by saying that the areas between the recipient sites are more lyophobic than the recipient sites. If the areas between sample recipient sites have a lower wettability than the sample recipient sites themselves for both polar and nonpolar solvents, the areas between sample recipient sites are said to be omniphobic. This situation is particularly preferred. Hydrophobic and/or lyophobic or omniphobic surfaces interrupted by less hydrophobic, lyophobic or omniphobic sample recipient sites, respectively, can be obtained by a wide range of methods, as detailed further below. In particular, in some embodiments, the sample support plate may comprise a hydrophobic and/or lyophobic or preferably omniphobic coating on the substrate, and the recipient sites interrupt said coating. This can be achieved, in particular, by first applying the coating uniformly to the substrate surface and subsequently removing the coating selectively at the sample recipient sites, e.g., by laser ablation or any other suitable method, as detailed further below.

In another aspect, the present invention also encompasses a MALDI mass spectrometer comprising a sample support plate as described above. A laser is arranged to direct a laser beam to the sample support plate so as to illuminate a beam spot on the sample support plate. It is then preferred that the beam spot has an area on said sample support plate that is at least 50% of the area of any one of said recipient sites. In even more preferred embodiments, the beam spot has an area on said sample support plate that exceeds the area of any one of said recipient sites. In this manner, it is possible to illuminate a complete sample recipient site at the same time, and rastering of the beam becomes unnecessary.

Nowadays, beam spots having a diameter as small as 10 μm have become possible; therefore, the maximum dimension of each sample recipient site may be as small as 10 μm or even smaller, e.g. 5 μm or even 2 μm. A practical lower limit might be approached if the sample recipient sites become smaller than the diffraction limit for the laser wavelength employed, e.g., smaller than 500 nm.

In addition, any MALDI mass spectrometer will generally comprise an ion extractor to extract ions generated by said laser beam in said beam spot, and a mass analyzer to analyze the mass-over-charge ratio of said ions. Both for ion extractors and for mass analyzers, a large number of designs are known in the art, and the invention is not limited to any particular design. In particular, the mass analyzer may be of the time-of-flight (TOF) type, of the (Fourier transform) ion cyclotron resonance (ICR or FT-ICR) type, or of other types, such as the ion trap type.

In yet another aspect, the present invention provides a method of manufacturing a sample support plate, the method comprising:

providing a substrate with a substantially flat substrate surface;

coating said substrate with a coating that is more hydrophobic, lyophobic or omniphobic than said substrate surface;

selectively removing the coating at predetermined locations to obtain a plurality of spatially separated sample recipient sites on said surface, said recipient sites being mutually separated by said coating, the recipient sites being arranged in a plurality of rows, each row consisting of a plurality of recipient sites whose centers are regularly spaced along a first direction with a predetermined periodicity, the rows being regularly spaced along a second direction perpendicular to said first direction with a predetermined centerline distance, each recipient site having a minimum lateral dimension and a maximum lateral dimension, the maximum lateral dimension being less than or equal to 200 μm, the periodicity along the first direction and the centerline distance along the second direction being chosen such that each recipient site has a next neighbor at an edge distance that is less than or equal to three times said minimum lateral dimension, preferably less than or equal to twice the minimum lateral dimension.

If the sample support plate is intended to be used for MALDI mass spectrometry, the substrate is preferably substantially electrically conducting at least in a surface-near region.

The invention further encompasses a method of sample preparation comprising:

providing a sample support plate as defined above; and, in arbitrary order:

applying a MALDI matrix to the sample recipient sites; and applying a sample to the sample recipient sites.

The present invention further provides a method of sample preparation. In this method, a bulk liquid containing the sample is distributed onto a sample support plate as described above, causing the bulk liquid to separate into discrete droplets located at the sample recipient sites. The sample may be applied by continuously moving an application device over the surface of the sample support plate, the application device acting to continuously distribute the bulk liquid over the surface. This method may be employed in the context of MALDI mass spectrometry, but is by no means limited to such procedures and is equally applicable in the context of other applications.

The bulk liquid may be selected from the group consisting of solutions, suspensions and emulsions of organic molecules in a carrier liquid, and suspensions of cells in a carrier liquid.

The present invention further relates to a method of preparing a plurality of samples on a sample support plate, each sample comprising a first and a second reagent. The method comprises:

providing a sample support plate as described above; and distributing first reagents in parallel by simultaneously moving a plurality of application devices distributed along the second direction relative to the surface of the sample support plate along the first direction while (preferably continuously) dispensing the first reagents from the application devices; and distributing second reagents in parallel by simultaneously moving a plurality of application devices distributed along the first direction relative to the surface of the sample support plate along the second direction while (preferably continuously) dispensing the second reagents from the application devices.

The application devices for the first and second reagents may be identical or different. The first and second reagents themselves may be identical or different. In some applications, at least one of the reagents may be a cell suspension, or cells may additionally be distributed to the sample recipient sites before distribution of the first reagent, between distribution of the first and the second reagent, or after distribution of the second reagent.

This method is particularly useful for high-throughput combinatorial screening. Again, this method may be employed in a variety of different applications and is not limited to sample preparation for MALDI-MS.

The above methods of sample preparation may be used, in particular, to apply cell suspensions to the sample support plate. The methods will then result in only a limited number of cells being deposited onto each sample recipient site. The exact number of cells at each site will generally fluctuate statistically. The mean number of cells deposited at each sample recipient site in this manner may be relatively low, e.g., it may be 1-100, preferably 1-10, most preferably 1-3. In one possible group of applications, the cells at each sample recipient site may be subjected to one or more analytical procedures, including mass spectrometry, fluorescence spectroscopy and other spectroscopic techniques. In this manner, similar results as with flow cytometry may be obtained. Another possible application is the distribution of cells to the sample recipient sites for the production of certain substances, e.g. the distribution of hybridoma cells for producing monoclonal antibodies.

The above methods of sample preparation may also be used in the context of amplification reactions for nucleic acids, in particular, for the distribution of fragments, oligos and/or primers to the sample recipient sites for carrying out amplification reactions such as PCR, LCR etc., in particular, emulsion PCR.

As will have become apparent from the above examples, the sample support plates and procedures described above may be used in a variety of different applications that require a defined aliquotation or defined parallel aliquotation either by volume or cell count, including but not limited to the following applications:

MALDI mass spectrometry;

amplification reactions;

multiplexed assays, in particular, microassays;

microanalysis;

separation/singularization of single cells onto sample recipient sites or aliquotation of a small number of cells on sample recipient sites for analytical purposes or for the production of substances like monoclonal antibodies;

crystallization of proteins in well-defined sample recipient sites.

The volumes that can be applied to each sample recipient site may range from the picoliter range to the microliter range. The samples may have a widely varying polarity, depending on the specific design of the sample support plate.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

For the purposes of the present invention, a "hydrophobic" surface is to be understood to be a surface which is not easily wettable by a polar liquid, in particular, by an aqueous liquid, specifically, water, repelling such a liquid. Generally, the contact angle of the liquid on a hydrophobic surface is more than 90 degrees. Conversely, a "hydrophilic" surface is to be understood to be surface with a comparatively small contact angle for such a liquid, certainly less than 90 degrees. A first area is "more hydrophobic" than a second area if the contact angle of such a liquid in the first area is larger than the contact angle of the same sample liquid in the second area. Similar definitions may also be used for the terms "lyophilic" and "lyophobic" for non-polar liquids. A surface is said to be "omniphobic" if it is both hydrophobic and lyophobic, i.e, if it is not easily wettable for a wide range of polar and non-polar liquids.

By the way of example, clean stainless steel surfaces exposed to normal air humidity are normally slightly hydrophilic for normal aqueous sample solutions due to hydroxy groups being created under the influence of the air. The same is true for most other metals, including precious metals. By the way of example, a plastic plate coated with a gold coating will generally be hydrophilic. Examples for omniphobic materials include polytetrafluorethylene (PTFE) and polysilazanes.

Figure 1:
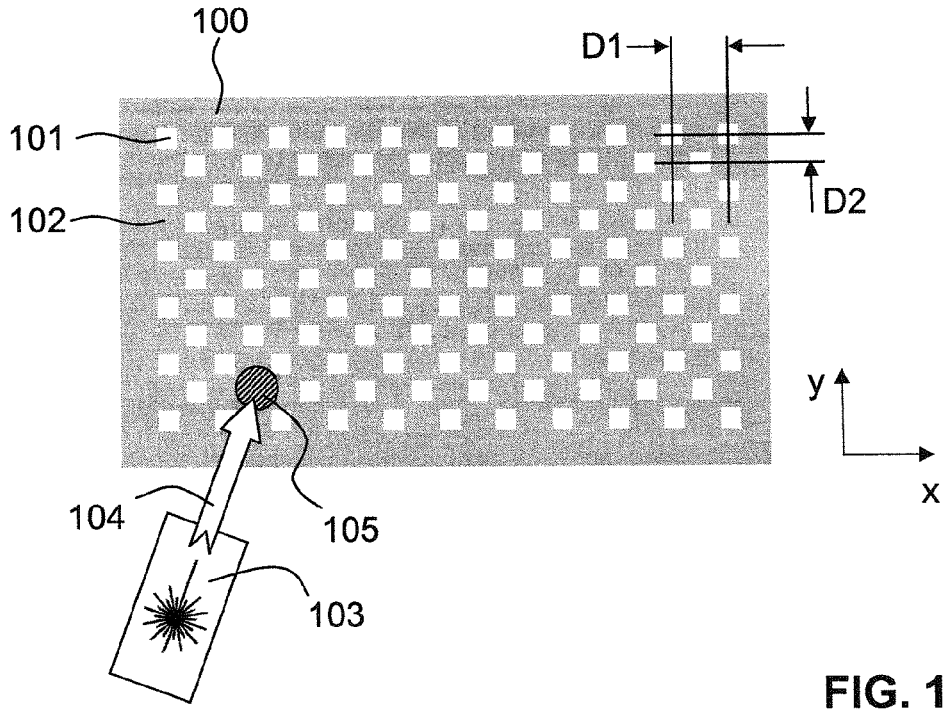
FIG. 1 shows a schematic illustration of a sample support plate in a first embodiment of the present invention, together with a schematic illustration of a laser impinging a laser beam onto the plate.

In FIG. 1, a first embodiment of a sample support plate according to the present invention is schematically illustrated. The sample support plate comprises a stainless steel substrate 100 having a flat, planar surface coated with an omniphobic polysilazane coating. A regular arrangement of a plurality of hydrophilic sample recipient sites 101 has been produced on the substrate by removing the coating at the sample recipient sites by laser ablation, exposing the stainless steel surface at these sites, while the areas 102 between sample recipient sites remain omniphobic. The sample recipient sites have a square shape. They are arranged in a plurality of rows, wherein the recipient sites within each row are spaced along a first direction (the x direction) by a center-to-center distance or periodicity D1. Adjacent rows are shifted with respect to each other along the x direction by half the distance D1. The rows are regularly spaced along a perpendicular second direction (the y direction) by a centerline distance D2. The centerline distance D2 along the y direction is half the center-to-center distance D1 along the x direction, i.e., D2/D1=1/2. This results in a "checkerboard" type arrangement of recipient sites. The edge distance from each sample recipient site to the closest adjacent sample recipient site is chosen to be less than twice the maximum lateral dimension of each sample recipient site. In the present example, the edge distance from a sample recipient site in any particular row to the closest sample recipient site in an adjacent row is actually even less than the size of each sample recipient site along its diagonal (which in the present case is the maximum lateral dimension). The sample recipient sites together form an array of rectangular shape whose borders are parallel to the x and y directions, respectively. The sample support plate itself is also rectangular, with the edges of the plate being parallel to the x and y directions, respectively, as well.

For carrying out MALDI mass spectrometry using such a sample support plate, the sample recipient sites are loaded with a MALDI matrix and with the actual sample, e.g., as described further below with reference to FIGS. 5-7. The sample support plate is then loaded into the sample chamber of a MALDI mass spectrometer. Such spectrometers are available commercially from a number of manufacturers, including Shimadzu/Kratos Analytical (Manchester, UK), Bruker Daltonik GmbH (Bremen, Germany) or Applied Biosystems. In such a spectrometer, the sample plate is illuminated with a laser beam 104 produced by a laser 103 (illustrated only very schematically in FIG. 1), which illuminates a beam spot 105 in the laser focus on the sample support plate. The laser beam acts to evaporate portions of the sample molecules together with the matrix and to ionize the sample molecules. The sample molecules are then accelerated electrostatically by an ion extractor and analyzed by, e.g., a time-of-flight mass analyzer, an ion cyclotron resonance (ICR) mass analyzer or an ion-trap mass analyzer. These steps are as such well known in the art.

The sample recipient sites 101 are preferably smaller than the beam spot 105. In other words, it is preferred that the beam spot illuminates a complete sample recipient site at the same time. In this way, an optimum sensitivity can be achieved. The beam spot size can vary considerably, depending on the laser and laser optics employed in the particular mass spectrometer. Typical beam spot diameters range from 10 to 200 μm. Consequently, the maximum lateral dimension of the sample recipient sites is preferably in the same range or below.

Figure 2:
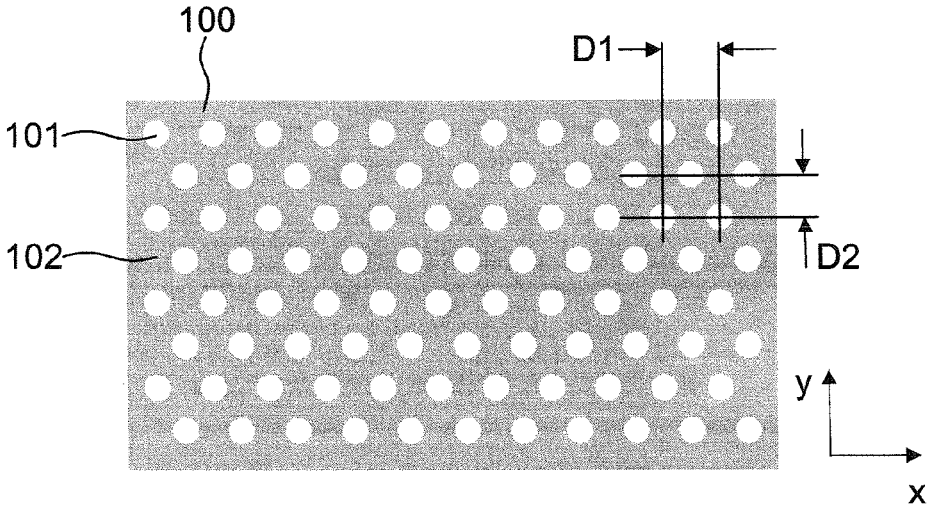
FIG. 2 shows a schematic illustration of a sample support plate in a second embodiment of the present invention.

FIG. 2 schematically illustrates a second embodiment of a sample support plate according to the present invention. Similar structures carry the same reference signs as for the first embodiment throughout the description that follows. Again, a stainless steel substrate 100 is coated with an omniphobic coating. Sample recipient sites 101 are produced in the coating by laser ablation. In this example, the sample recipient sites 101 are of circular shape. They are again arranged in a plurality of rows, adjacent rows being shifted relative to each other again by half the center distance of the sample recipient sites along the x direction. However, the ratio between the centerline distance D2 along the y direction and the center distance D1 along the x direction is here chosen to be approximately $\sqrt{3}/2 \approx 0.87$, resulting in an approximately trigonal arrangement of the sample recipient sites rather than the "checkerboard" arrangement of FIG. 1.

Figure 3:
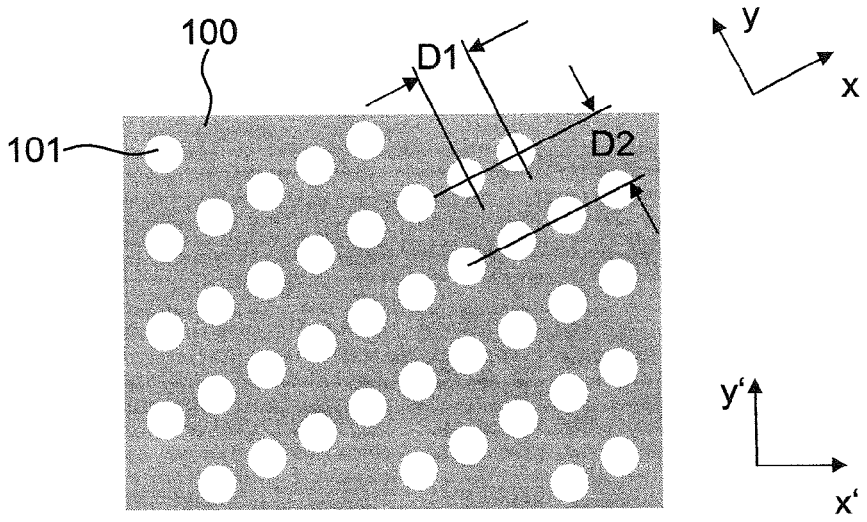
FIG. 3 shows a schematic illustration of a sample support plate in a third embodiment of the present invention.

A third embodiment of a sample support plate according to the present invention is schematically illustrated in FIG. 3. Here, the rows of sample recipient sites 101 (direction x) are inclined relative to the borders of the array of sites and to the edges of the sample support plate by an angle that is different from 0 or 90° (here approximately 27° relative to the longitudinal edge, whose direction is designated by x'). This orientation of the rows ensures that any straight line that is drawn parallel to the longitudinal edges of the sample support plate at any arbitrary position within the array will cut at least three sample recipient sites. Of course, the exact number of sample recipient sites that will be cut by the straight lines will depend on various factors, such as the number of recipient sites in the array, the shape and size of the array, size of the recipient sites, their distance along the x direction, the row spacing along the y direction, the amount of shift along the x direction between adjacent rows (which here is approximately 0.2×D1), and the tilt angle between the x and x' directions. While no exact expression linking these factors can here be given to exactly calculate the number of recipient sites cut by each straight line, a person skilled in the art will readily appreciate how these factors may be varied to achieve the above-mentioned condition that at least two, three, four, or five etc. sample recipient sites are cut by such horizontal straight lines. The advantages of such arrangements will become apparent from the discussion of different sample application methods below.

Figure 4:
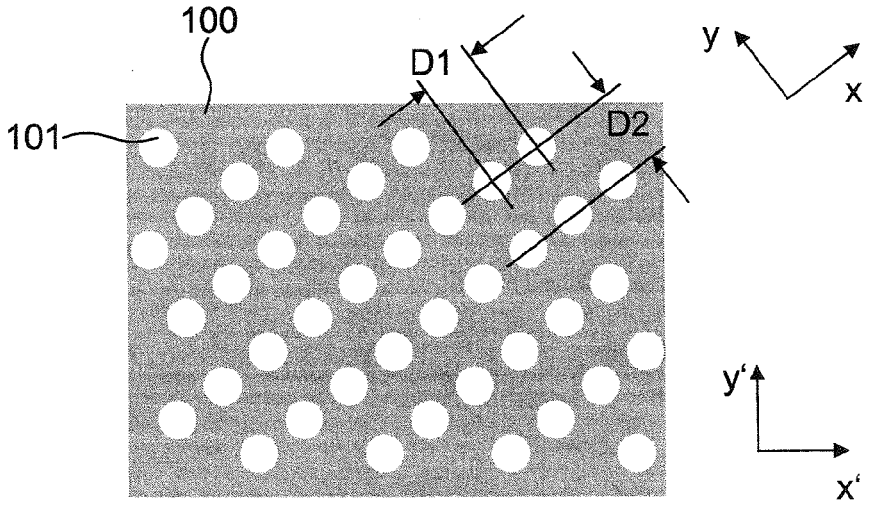
FIG. 4 shows a schematic illustration of a sample support plate in a fourth embodiment of the present invention.

FIG. 4 provides a fourth embodiment of a sample support plate according to the present invention, for which a different spacing of rows and a different tilt angle between the x and x' directions has been chosen.

Whereas the sample recipient sites of the above examples are of square and circular shape, respectively, other shapes are possible, including elliptic, rectangular, triangular, and regular polygonal and irregular polygonal shapes.

Figure 5:
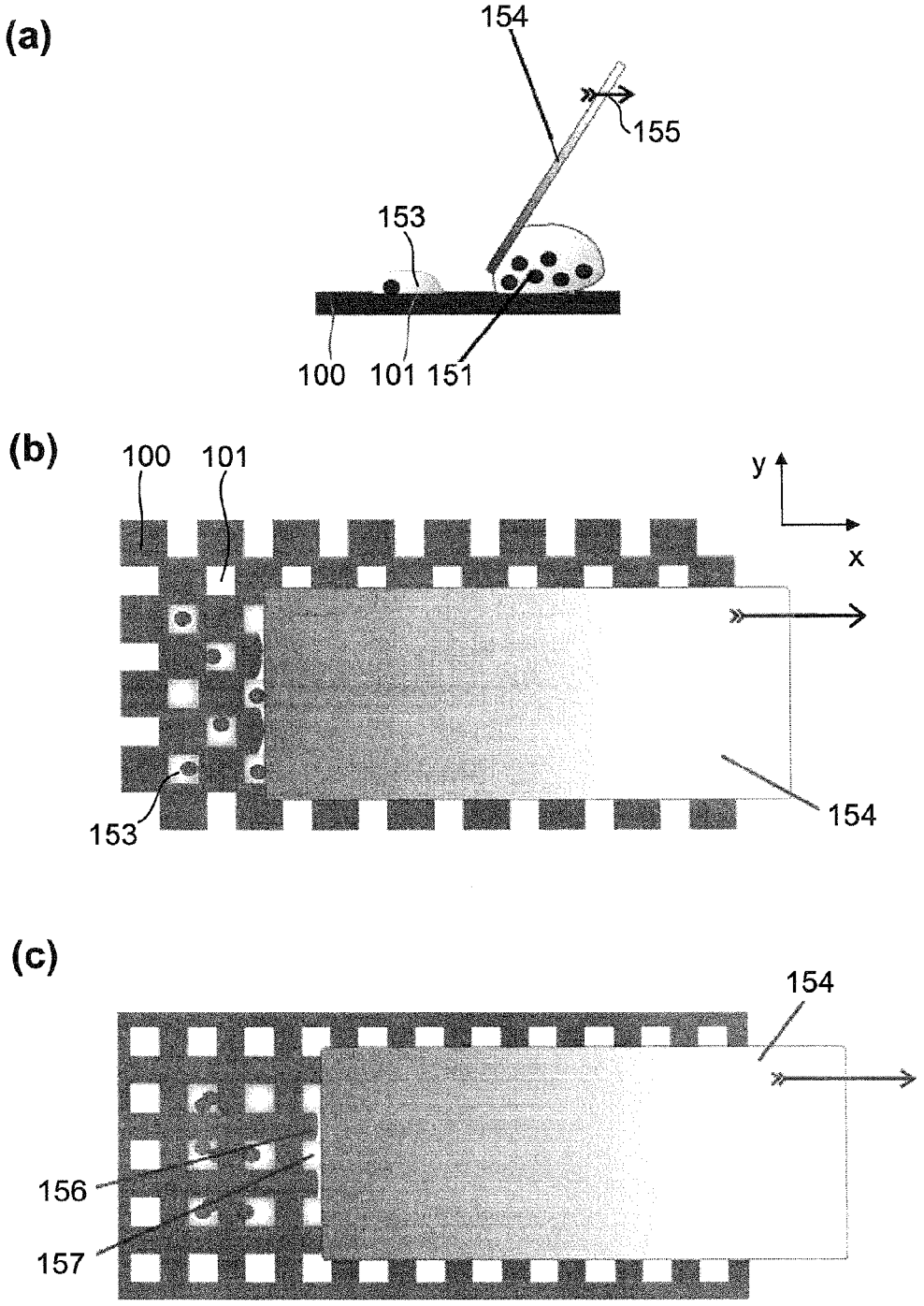
FIG. 5 shows a schematic illustration of (a) the deposition of a cell medium onto (b) a checkerboard-type sample support plate and (c) a sample support plate having a regular square arrangement of recipient sites.

FIG. 5(*a*) illustrates a first example of how a sample may be applied to a sample support plate according to the present invention. A bulk aqueous liquid, in the present example a cell suspension comprising cells 151 that are to be investigated, is spread onto a sample support plate 100 with the aid of a spreading device in the form of a glass slide 154. To this end, the glass slide is moved over the sample support plate 100 along the x direction (arrow 155). During the spreading of the liquid, liquid droplets 153 accumulate at the hydrophilic sample recipient sites 101, while the liquid is repelled from the hydrophobic polysilazane coating between the sample recipient sites.

Two different kinds of arrangements of sample recipient sites are illustrated in FIGS. 5(*b*) and 5(*c*). In FIG. 5(*b*), the spreading of the liquid onto a "checkerboard" arrangement is illustrated. In this arrangement, during the spreading of the liquid, each point along the edge of the glass slide moves alternately over sample recipient sites and over the hydrophobic areas between such sites. This results in a homogeneous splitting of the bulk liquid into similarly sized droplets on the sample recipient sites and in a comparatively large proportion of sample recipient sites being loaded with the desired number of cells (here, preferably one single cell per sample recipient site). The regular square arrangement of FIG. 5(*c*) is less preferred in such a situation, since there are portions of the edge of the glass slide that will never move over a sample recipient site, such that liquid in these regions of the glass slide may have a larger tendency to accumulate outside the sample recipient sites and instead in the hydrophobic regions 156 of the sample support plate. Droplets formed in the hydrophobic regions might ultimately find their way to one of the sample recipient sites and join with the droplets 157 existing there already; however, this process will be more arbitrary than for the "checkerboard" arrangement. This may lead to a less homogeneous distribution of cells over the sample recipient sites and may result in more cells being deposited outside sample recipient sites. Therefore, arrangements in which the rows of sample recipient sites are shifted with respect to each other, as in the "checkerboard" arrangement of FIGS. 1 and 5(*b*) or in the trigonal arrangement of FIG. 2, are preferred over simple regular square arrangements as in FIG. 5(*c*).

If such a spreading method is employed with the sample support plates of FIG. 3 or 4, the glass slide moving along the x' direction, the particular arrangement of the sample recipient sites in inclined rows ensures that any point of the edge of the glass slide will move over at least three sample recipient sites during the spreading operation. Therefore, such an arrangement again ensures a relatively homogeneous distribution of sample over the recipient sites.

For cell analysis, the following protocol for loading the cells and the MALDI matrix to the sample support plate may be employed: First, the cell suspension is spread onto the sample support plate, while the plate is preferably kept at constant temperature with the aid of a Peltier element. The cells may then optionally be quenched by application of a quenching liquid, e.g., ethanol. Only then the matrix may be applied by the usual methods, e.g. by immersion into a matrix solution (possibly under the action of ultrasound), by spraying, by electrospraying or casting. Alternatively, it is also possible to first load the sample recipient sites with the matrix and then apply the cell suspension. A preferred matrix material is 9-aminoacridine (9AA).

Figure 6:
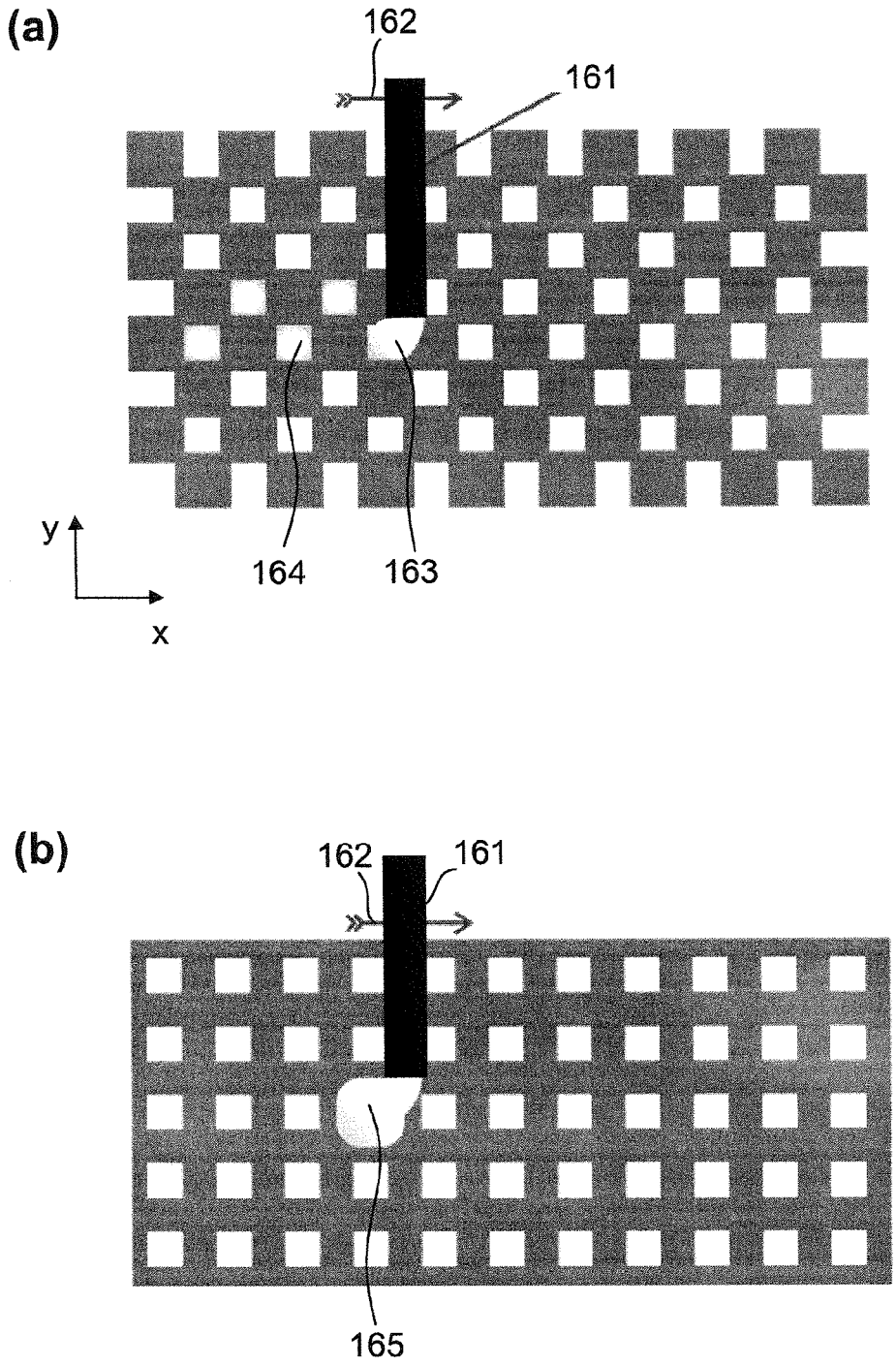
FIG. 6 shows a schematic illustration of (a) the deposition of an effluent from a capillary onto (b) a checkerboard-type sample support plate and (c) a sample support plate having a regular square arrangement of recipient sites.

FIG. 6 illustrates a second example of how a bulk sample liquid 163 may be applied to a sample support plate according to the present invention. Here, the sample support plate is loaded with the aid of a capillary 161 moving over the plate along the x direction (arrow 162) and providing a continuous stream of bulk liquid. In the "checkerboard" arrangement of FIG. 6(*a*), the bulk liquid 163 will be properly split into sample droplets 164 accumulating in the sample recipient sites even if the capillary is severely misaligned with respect to the rows of sample recipient sites. In the simple regular square arrangement of FIG. 6(*b*), there is a larger tendency for the sample liquid to initially accumulate in the hydrophobic regions between the sample recipient sites in case of such misalignment. In such cases, the liquid might move to a sample recipient site only once a droplet 165 has reached a certain size. This will again lead to a less homogeneous distribution than for the "checkerboard" arrangement of FIG. 6(*a*). It is readily apparent that arrangements as in FIG. 3 or 4 will, on the other hand, again ensure a relatively homogeneous distribution, since misalignment will be no issue in such arrangement.

Figure 7:
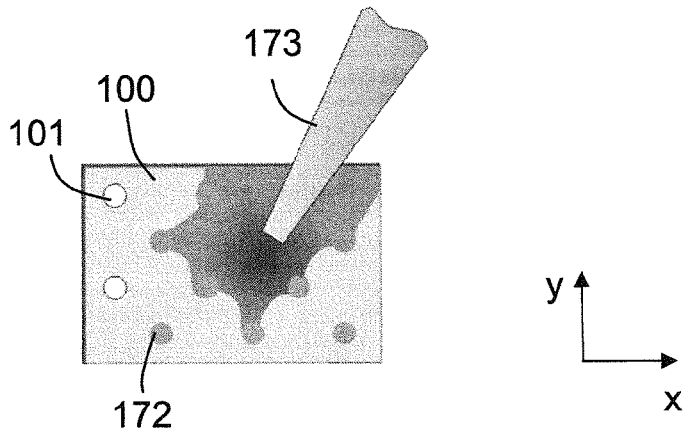
FIG. 7 shows a schematic illustration (a) of the distribution of a bulk liquid onto the sample support plate by a pipette and (b) of the situation after excess liquid has been pulled back into the pipette.
Figure 7:
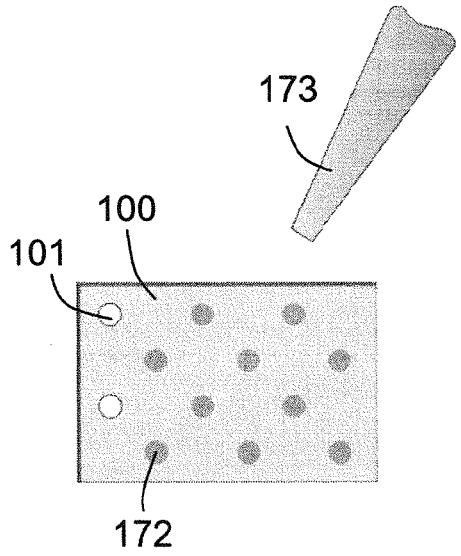

FIG. 7 illustrates a third example of how a bulk sample liquid 163 may be applied to a sample support plate according to the present invention. Here, a pipette 173 is employed to deposit a large drop of bulk liquid onto a region encompassing several sample recipient sites (FIG. 7(*a*)). The bulk liquid will automatically split into droplets in nearby sample recipient sites (e.g., site 172). Excess liquid may then be drawn back into the pipette, resulting in a homogeneous distribution of sample over a plurality of recipient sites (FIG. 7(*b*)).

Figure 8:
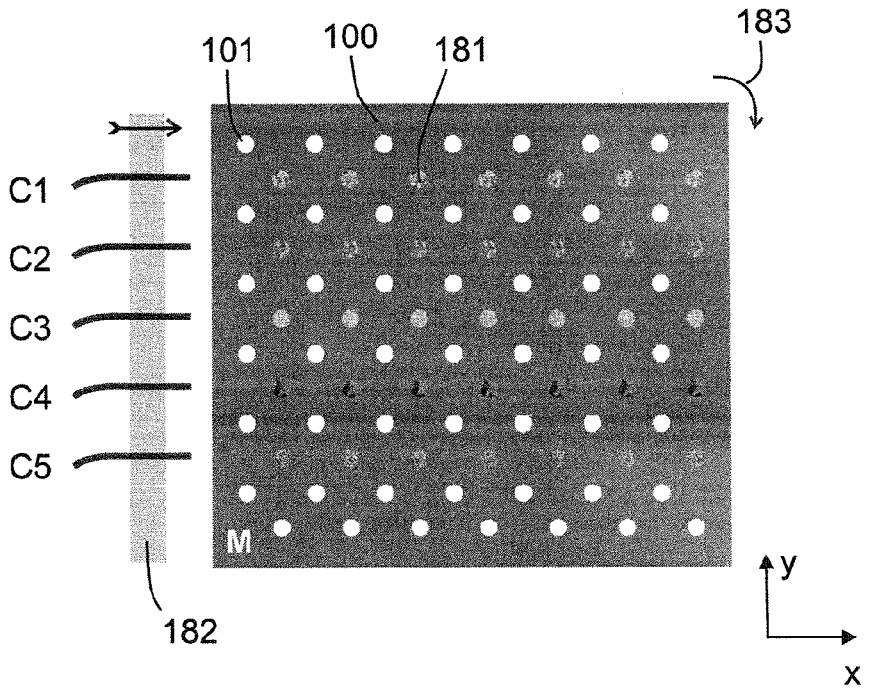
FIG. 8 shows a possible method for applying a plurality of samples simultaneously, useful for combinatorial screening.
Figure 8:
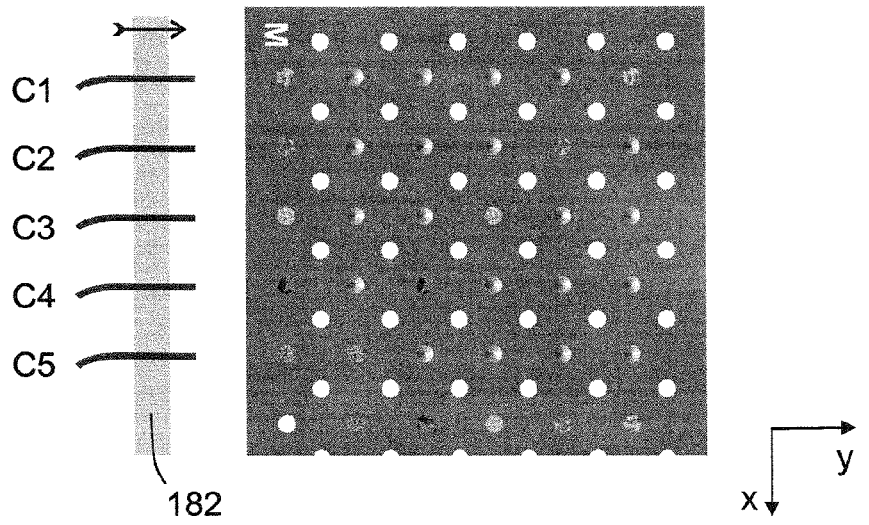

FIG. 8 illustrates a method of applying a plurality of samples simultaneously for high-throughput screening applications. A plurality of capillaries C1, C2, C3, C4, C5 are supported on a common support 182. Each capillary serves to dispense a different first reagent to the sample support plate by continuously moving the capillaries over the support plate along the x direction (or moving the sample support plate below the capillaries) while dispensing the reagents from the capillaries. This results in each first reagent being distributed over at least one (here exactly one) first row of sample recipient sites 181 (FIG. 8(*a*)). The sample support plate is then turned by 90° (arrow 183), and the same or different second reagents are again applied in the same manner along the y direction to a plurality of second rows of sample recipient sites, the second rows being perpendicular to the first rows. This results in a situation in which the sample recipient sites at the intersections of the first and second rows will have received both a first and a second reagent (FIG. 8(*b*)). In this manner, a large number of combinations of first and second reagents can be very rapidly applied, without the need of exact pipetting of reagents.

The sample support plate of the present invention may be manufactured as follows: First, a substrate having a flat surface is provided. For MALDI applications, it is generally necessary that the surface of the substrate defines a substantially constant electric potential, since the MALDI process requires a substantially homogeneous electric field for acceleration and a dissipation of charges accumulating at the surface. Therefore, MALDI sample plates often have a substrate made of a metal, of a metallized plastic or glass plate or of a plastic or glass plate coated with gold. However, for other applications, the substrate may be non-conducting.

The surface of the substrate is then coated with a thin hydrophobic and/or lyophobic, preferably omniphobic, coating, which may or may not be a monolayer of functional molecules. Such coatings are well known in the art. The coating may preferably comprise a polysilazane. Polysilazane-based coating materials are available commercially, e.g., the coating CAG 37 available from Clariant Advanced Materials GmbH, Sulzbach, Germany.

In the simplest case, such coatings may be applied by spraying. Examples of other polysilazane-based coatings are described, e.g., in US 2005/0169803 and references contained therein. However, many other types of coatings may also be used, including silicones, alkylchlorosilanes, tin-organic compounds, alkane thioles or fluoroalkane thiols, etc. Many different methods of coating are known. For example, for a possible coating process with a thiol-based coating, explicit reference is made to the coating process described in U.S. Pat. No. 6,287,872. Preferably the coating is very thin, preferably less than 10 micrometers. Ideally, the coating preserves a certain amount of electric conductivity of the coated surface.

The sample recipient sites are then preferably created by ablating the coating at the desired locations, e.g., by application of a laser beam. Other possibilities include spark erosion, reactive ion etching and other ablation methods or photolithographic methods. Alternatively, it is also possible to cover the desired locations on the substrate surface with a hydrophilic or lyophilic lacquer before application of the coating or to attach hydrophilic or lyophilic spots to the coating, e.g., by application of amphiphilic substances which bond to the coating and create a surface having different wetting properties at these locations. In yet another embodiment, the coating may be destroyed at the desired locations by applying disintegrating chemicals. In some of these methods, the relevant substances may be applied to the surface or the coating in the same manner as in an inkjet printer.

In other embodiments, the surface of the substrate may be micro- and/or nanostructured to obtain a superhydrophobic surface, as described, e.g., in M. Groenendijk, "Fabrication of super hydrophobic surfaces by fs laser pulses", *Macro Material Processing*, May 2008, pp. 44-47. The sample recipient sites may then be obtained, e.g., by destroying the superhydrophobic surface structure at these sites. Many other fabrication methods are possible.

Figure 9:
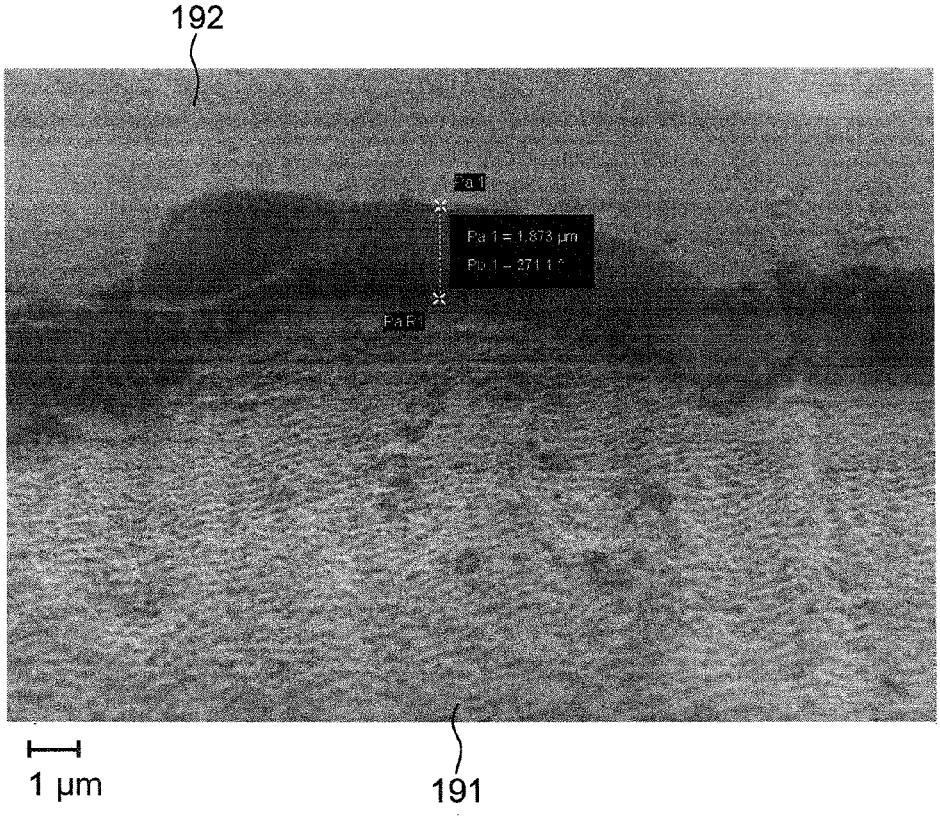
FIG. 9 shows an electron micrograph of the edge of a sample site of a sample support plate according to the present invention.

FIG. 9 shows an electron micrograph of the edge of a sample recipient site after ablation of a polysilazane coating with a picosecond laser system (SuperRapid YAG laser, Lumera Laser, Kaiserslautern, Germany; 10 ps pulses; wavelength 355 nm; frequency 50 kHz; average power 100 mW). The laser beam was focused and scanned over the surface of the sample using a galvanoscanner (hurryScan10 from Scanlab, Puchheim, Germany). The telecentric lens with a 100 mm working distance provided a constant focal spot of approx. 10 μm at the surface of the scanner area. The scan speed (150 mm/s) and the hatch were selected to have a 3 μm spot-to-spot distance. In the upper part of the micrograph, the hydrophobic coating 192 (here polysilazane) is well visible, whereas in the lower part, the substrate surface 191 (here stainless steel) is visible. In the present example, the coating had a thickness of approximately 3 μm.

Figure 10:
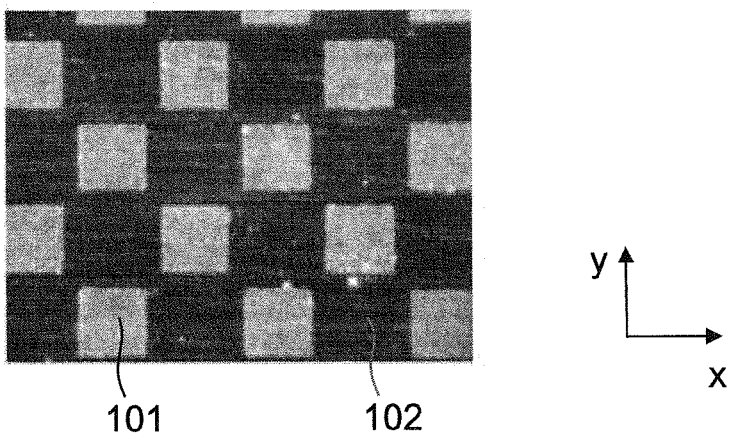
FIG. 10 shows an enlarged photograph of a portion of a sample support plate according to the present invention.

FIG. 10 shows an example of a "checkerboard"-type pattern obtained after laser ablation of a polysilazane coating on a stainless steel substrate. Sample recipient sites 101 exhibiting the hydrophilic stainless steel surface are separated by hydrophobic areas 102 with coating.

Figure 11:
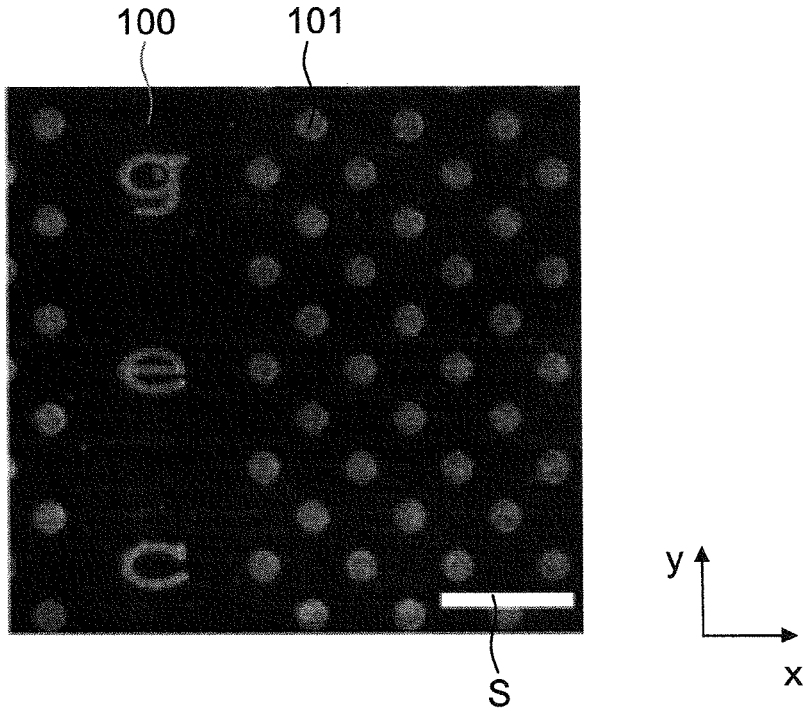
FIG. 11 shows an enlarged photograph of a portion of another sample support plate according to the present invention, loaded with 9-aminoacridine MALDI matrix.

FIG. 11 shows a sample support plate 100 comprising a microarray of sample recipient sites preloaded with 9AA matrix material. The length of the scalebar S corresponds to 500 μm. Each sample recipient site 101 has a diameter of 100 μm. The periodicity along the x direction is approximately 400 μm, resulting in an edge distance between adjacent sample recipient sites along the diagonal of approximately 180 μm (i.e., less than twice the diameter of the recipient sites).

Figure 12:
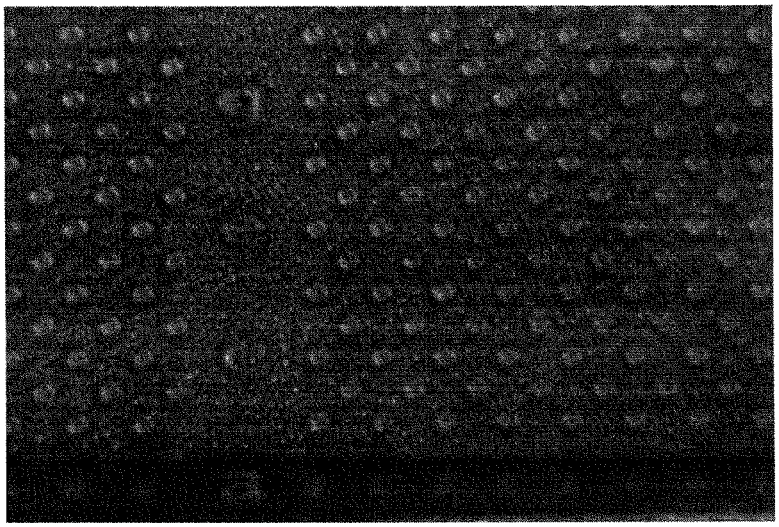
FIG. 12 shows a portion of the sample support plate of FIG. 7, loaded with water droplets.

FIG. 12 illustrates the formation of water droplets at high air humidity on the sample support plate of FIG. 11. Large droplets form on the sample recipient sites, while only very small droplets form in the hydrophobic areas between such sites. These droplets tend to attach to the large droplets at the sample recipient sites. Solid particles trapped in the large droplets remain separated and associated with a particular sample recipient site at all times, even during prolonged microscopic observation at high air humidity (maintained to prevent evaporation of the liquid carrier).

The recipient sites of the sample support plate of FIG. 11 were loaded with *Euglena gracilis* cells. The loaded recipient sites are apparent from FIG. 13. Recipient sites typically contained zero, one or two cells, with some sites containing more than two cells.

Figure 13:
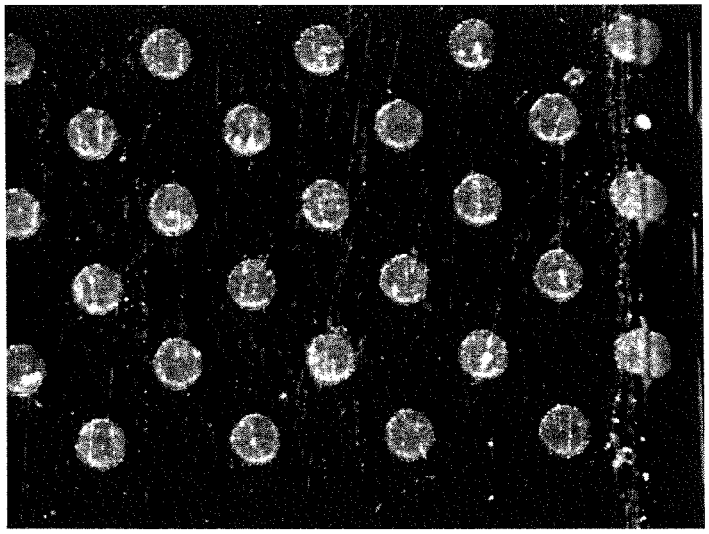
FIG. 13 shows an enlarged photograph of a portion of the sample support plate of FIG. 11, loaded with *Euglena gracilis* cells.
Figure 14:
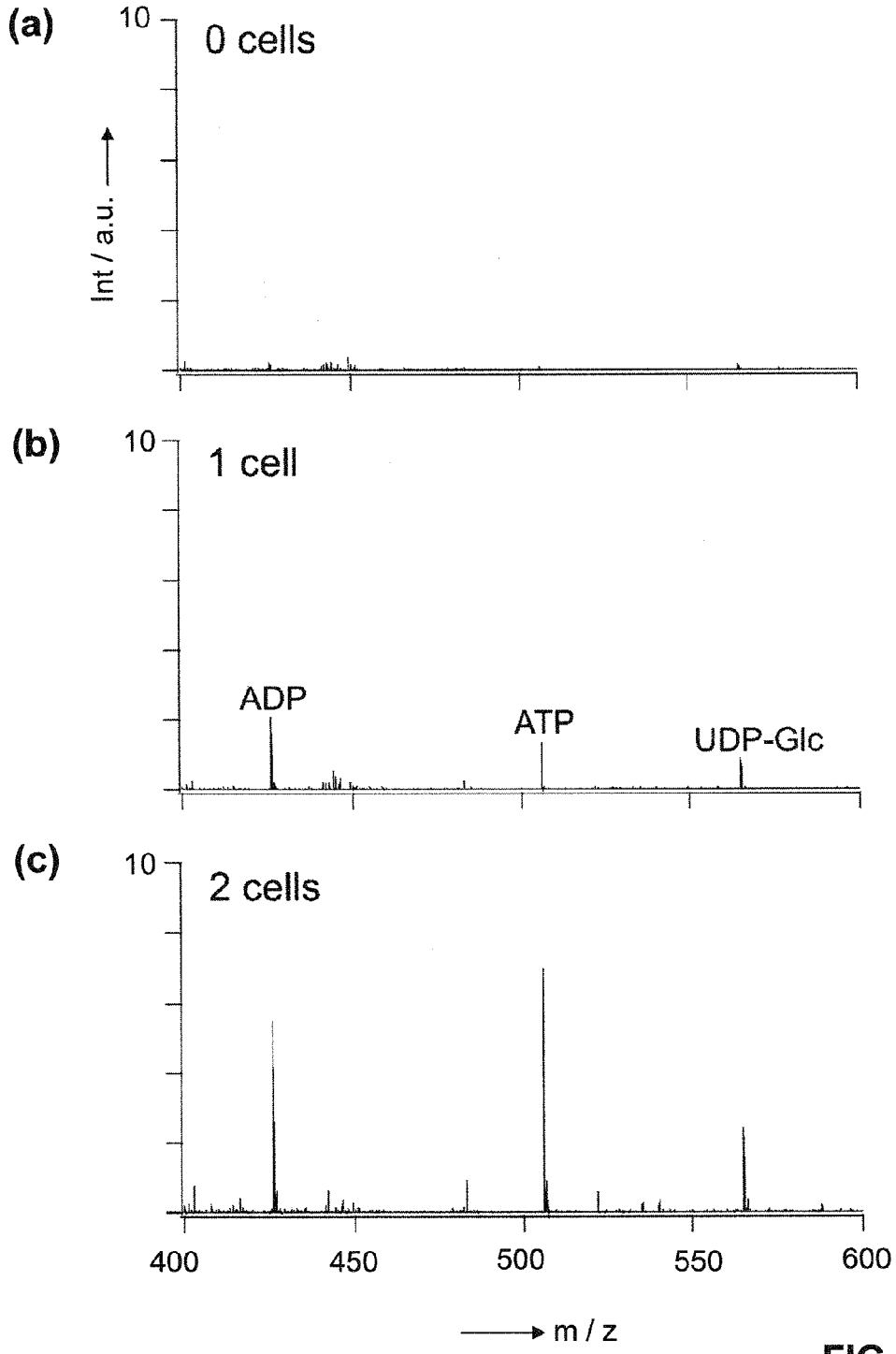
FIG. 14 shows MALDI-MS spectra of parts of the cell contents of (a) zero, (b) one and (c) two cells of *Euglena gracilis* after lysis, obtained using the sample support plate of FIG. 8.

FIG. 14 shows three different MALDI-TOF mass spectra obtained from the recipient sites of FIG. 13. Each spectrum was obtained from a single recipient site loaded with (a) zero, (b) one and (c) two cells of *Euglena gracilis*, as determined microscopically before obtaining the mass spectra. The signal intensity scales with the number of cells. These spectra illustrate that single-cell sensitivity can be readily obtained with the sample support plates of the present invention.

Figure 15:
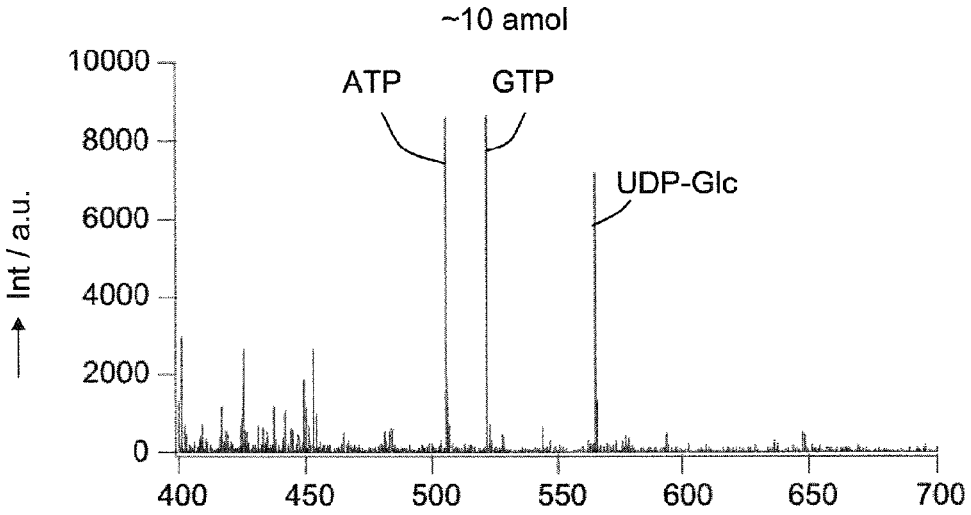
FIG. 15 shows MALDI-MS spectra of (a) approximately 10 attomoles and (b) approximately 1 attomole of a mixture of primary metabolites, obtained from single recipient sites on a sample support plate of the present invention, each recipient site having a diameter of 50 micrometers, in negative ion mode with 9AA matrix.
Figure 15:
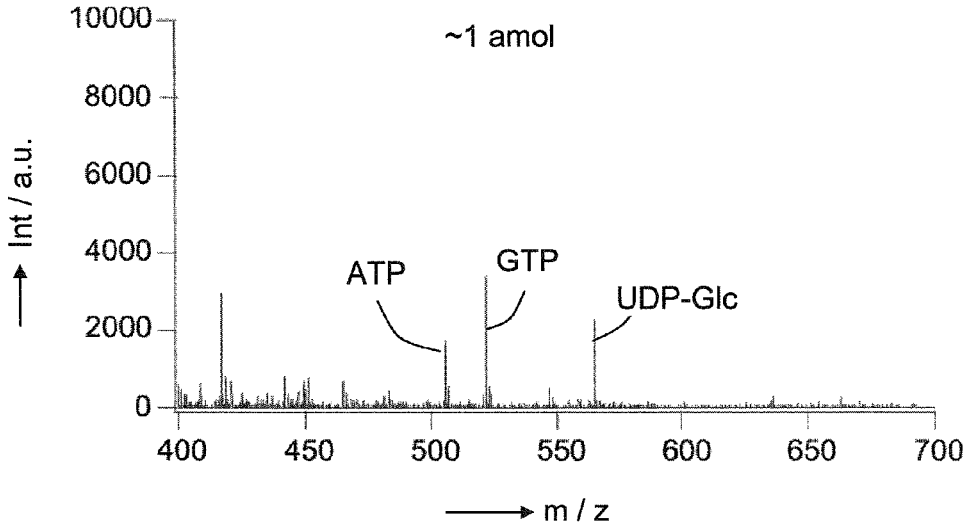

FIG. 15 shows MALDI-TOF mass spectra of (a) approximately 10 attomoles and (b) approximately 1 attomole of a mixture of primary metabolites (ATP=adenosine triphosphate, GTP=guanosine triphosphate, UDP-Glc=uridine diphosphate glucose).

Figure 16:
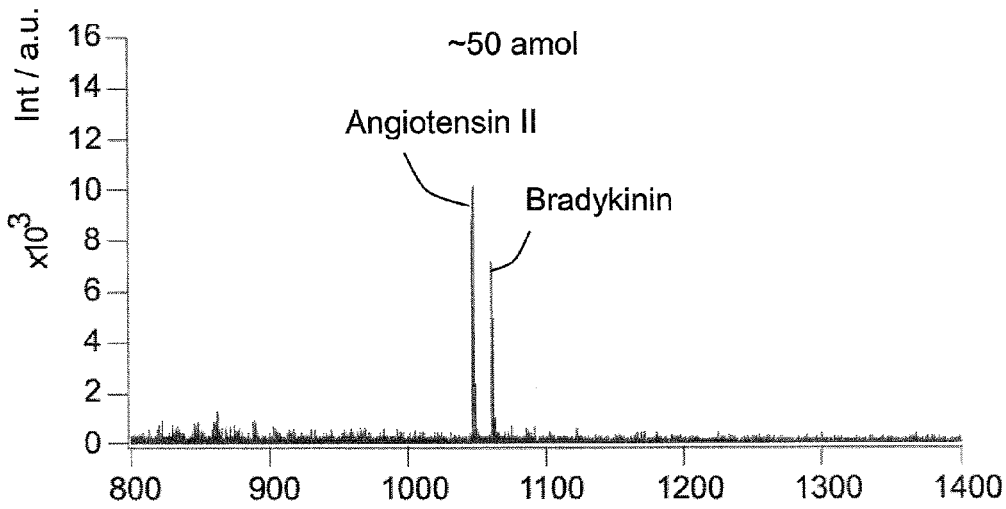
FIG. 16 shows MALDI-MS spectra of (a) approximately 50 attomoles and (b) approximately 5 attomoles of the peptides Angiotensin II and Bradykinin, obtained from single recipient sites on a sample support plate of the present invention, each recipient site having a diameter of 50 micrometers, in positive ion mode with alpha-cyano-4-hydroxycinnamic acid (CHCA) as matrix material.
Figure 16:
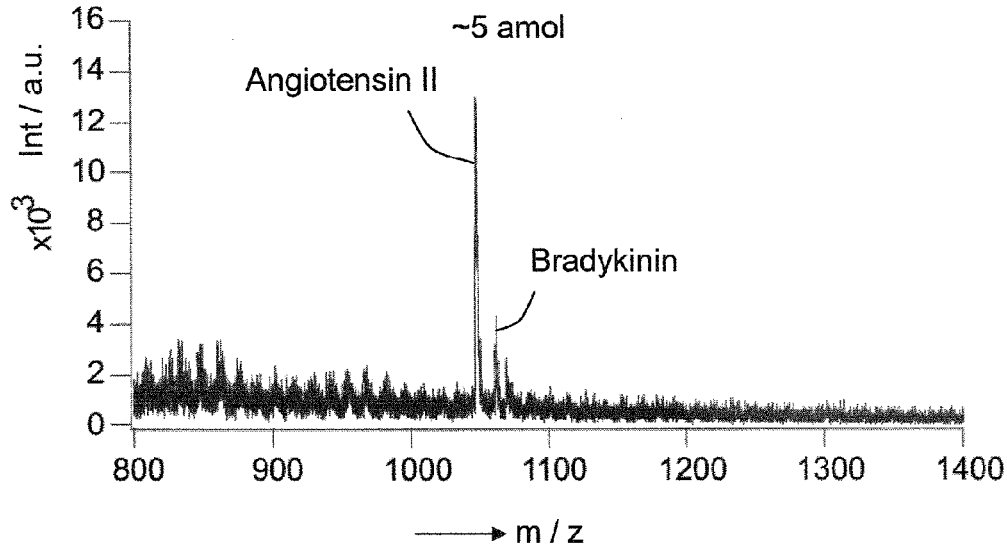
Figure 17:
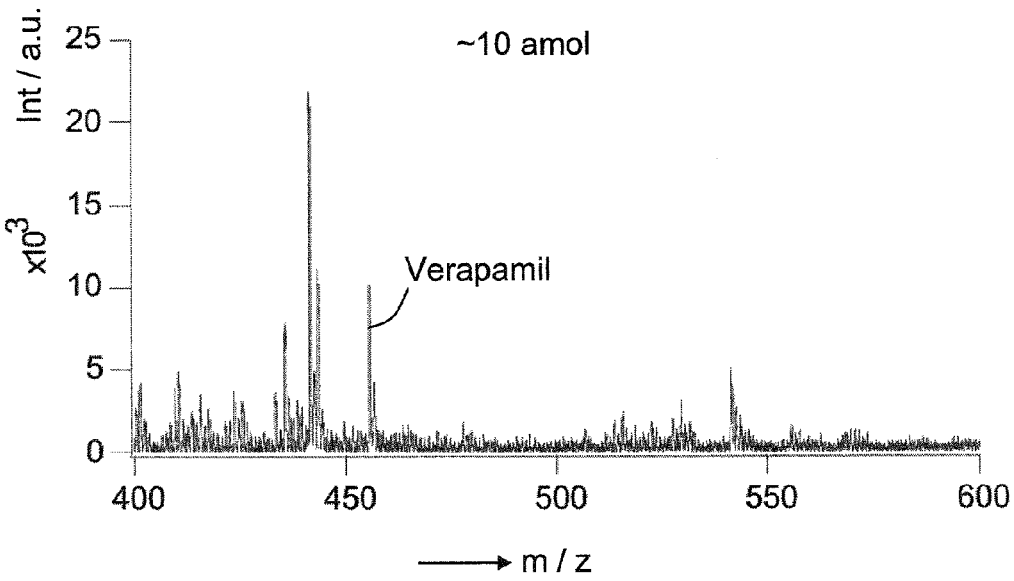
FIG. 17 shows a MALDI-MS spectrum of approximately 10 attomoles of Verapamil, obtained from single recipient sites on a sample support plate of the present invention, each recipient site having a diameter of 50 micrometers, in positive ion mode with CHCA matrix.
Figure 18:
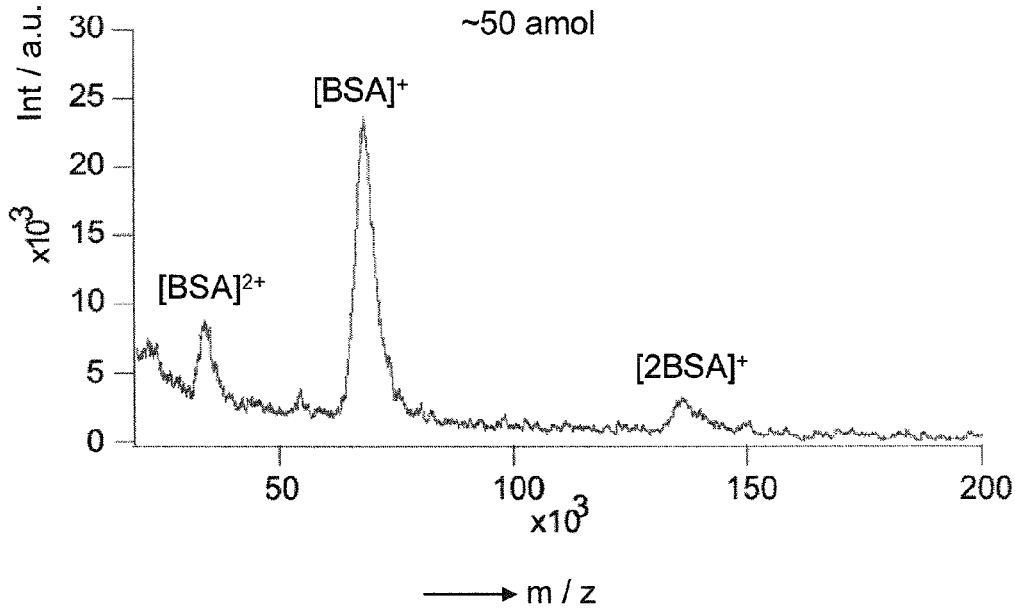
FIG. 18 shows MALDI-MS spectra of approximately 50 attomoles of bovine serum albumine (BSA), obtained from single recipient sites on a sample support plate of the present invention, each recipient site having a diameter of 50 micrometers, in positive ion mode with high-mass detector, exponential smoothing, matrix: sinapinic acid.

FIG. 16 shows MALDI-TOF spectra of (a) approximately 50 attomoles and (b) approximately 5 attomoles of the peptides Angiotensin II and Bradykinin. FIG. 17 shows a spectrum of approximately 10 attomoles of Verapamil, while FIG. 18 shows a spectrum of approximately 50 attomoles of bovine serum albumine. All spectra were obtained from single circular recipient sites on a sample support plate of the present invention, each recipient site having a diameter of 50 micrometers. These spectra illustrate the excellent sensitivity that can be obtained with the sample support plates of the present invention over a very broad mass range.

Figure 19:
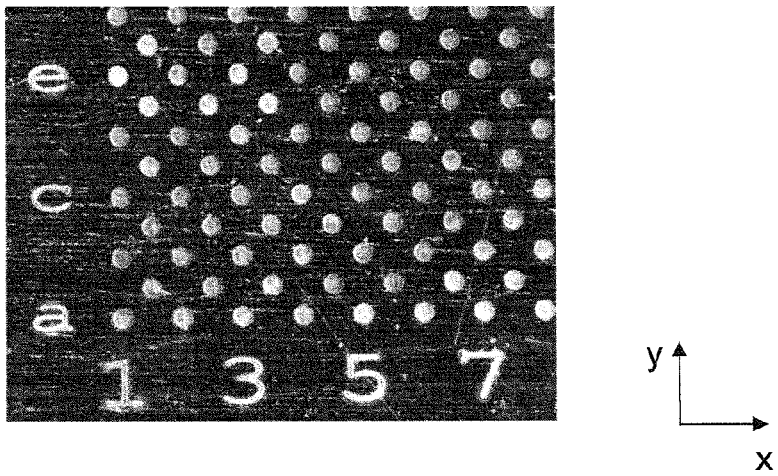
FIG. 19 shows enlarged photographs of (a) a portion of a sample support plate having recipient sites with a diameter of 100 micrometers, filled with 9-aminoacridine MALDI matrix; (b) an enlarged portion of the sample support plate of part (a); and (c) a portion of a sample support plate having recipient sites with a diameter of 10 micrometers, filled with 9-aminoacridine MALDI matrix.
Figure 19:
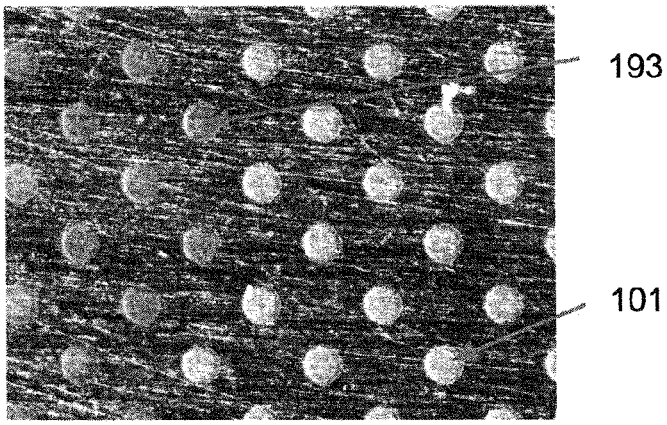
Figure 19:
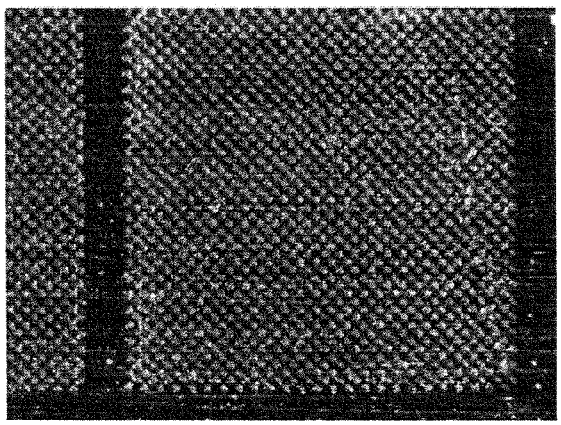

FIG. 19 shows further examples of sample support plates according to the present invention: (a) a portion of a sample support plate having recipient sites with a diameter of 100 μm, partially filled with 9AA matrix; (b) an enlarged portion of the sample support plate of part (a), showing empty sites 101 and filled sites 193; and (c) a portion of a sample support plate having recipient sites with a diameter of 10 μm, filled with 9AA matrix. The latter sample support plate may be used with MALDI-MS systems having a laser focus diameter down to 10 μm.

Figure 20:
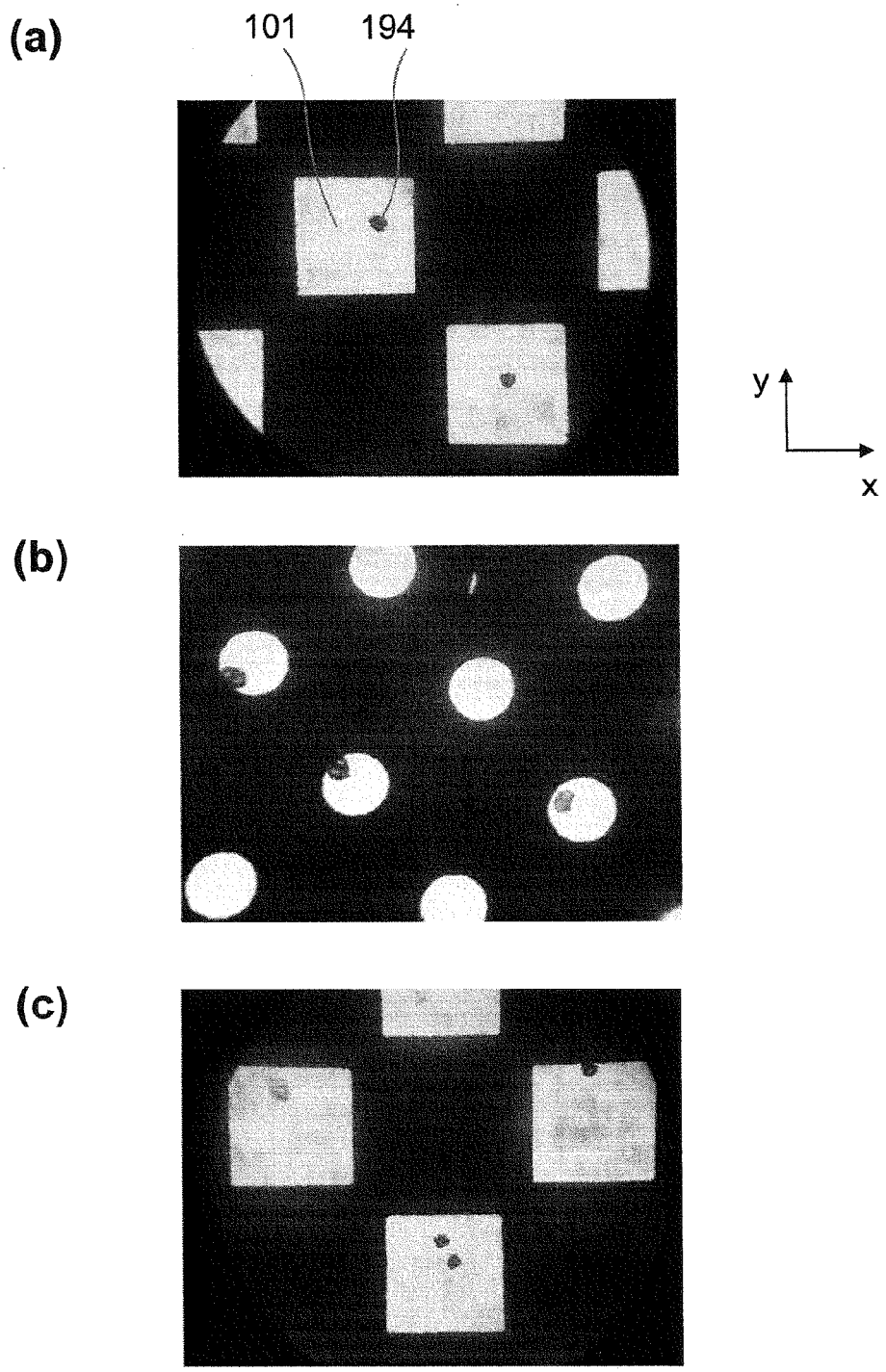
FIG. 20 shows enlarged photographs of portions of sample support plates having a substrate made from a transparent synthetic material, coated with a gold layer that was derivatized with 1H,1H,2H,2H-perfluordodecane-1-thiol from Asemblon (Redmond, Wash., USA).

FIG. 20 shows enlarged photographs of portions of sample support plates having a substrate made from a transparent synthetic material, coated with gold and functionalized by fluorinated thiols. The transparent sample recipient sites are partially loaded with cells 194. Such sample support plates are useful for special applications, e.g. thorough optical imaging of the cells deposited on the micro-array using a microscope prior to analysis by MALDI-MS.

The functional design of the MALDI plate according to this invention offers fast unsupervised distribution of MALDI matrix, cell suspensions and liquid samples among multiple sites on MALDI plates. It also provides seamless deposition of effluents from microfluidic devices on MALDI plates enabling sensitive and high-throughput mass spectrometric analysis.

Unlike in most prior-art sample-focusing supports for MALDI-MS, the diameter of each sample site may be made smaller or equal to that of the MALDI laser beam; therefore, there is no need for rastering the sample deposit. This speeds up analysis while preserving high sensitivity of the measurement. It also eliminates issues due to inhomogeneous matrix crystallization: the whole sample is scanned at the same time.

The proposed design of the arrays enables seamless distribution of biological cells among the recipient sites. This can be done in a short period of time, manually or with a simple mechanical aid.

Deposition of liquids on the high-density mass spectrometry micro-arrays does not require alignment. Misalignment is compensated by the geometry of the recipient site pattern. For example, the micro-array can be used for deposition of effluents from nanoflow LC columns. This is important, e.g., for applications in proteomics where liquid chromatography (LC) separations are often coupled with MALDI spotters; using nanoflow LC would limit expenditure of costly chemicals.

Use of micro-arrays for analysis of liquid samples by MALDI-MS increases homogeneity of the sample deposit, minimizes consumption of the sample and of the toxic MALDI matrix.

Possible applications of the high-density micro-arrays described here include:

a) Collection of effluents from microscale capillaries or microfluidic devices: The present invention enables facile transfer of liquid samples, for example, when delivered with microscale capillaries onto the surface, prior to mass spectrometric analysis. This is important in a range of bioassays incorporating microfluidics for sample preparation and treatment.

b) High-throughput combinatorial screening: The invention enables performing biochemical reactions in nano- and picoliter volume in a high-throughput manner prior to mass spectrometric analysis, potentially lowering the costs of drug discovery process. It can allow for the screening of drug interactions with target proteins that are only available in small quantities, thus speeding up the lead compound selection. Various types of information on the reaction progress can be obtained from such analysis; this stays in contrast with the affinity/activity screening methods incorporating optical detection. Moreover, the screening can be conducted also with live cells that can readily be patterned in the high-density micro-array, as outlined below.

c) Analysis of cancer and microbial cells: Mass spectrometry, including MALDI-MS enables analysis of numerous chemical species at the same time. However, technical obstacles exist that hinder direct application of mass spectrometry in high-throughput analysis of individual (and even small numbers of) cells. The dual function of the high-density mass spectrometry micro-array facilitates unsupervised handling of cells and subsequent mass spectrometric analysis.

d) Sensitive and reproducible analysis of solutions delivered in nanoliter and microliter volumes: Conventional MALDI-MS analysis of liquid samples is generally not reproducible enough to perform routine quantitative analyses of biological samples. High-density mass spectrometry micro-array can address this problem to some extent.

Whereas preferred embodiments have been described mainly in the context of MALDI-MS applications, the invention is by no means limited to MALDI-MS, and sample support plates according to the present invention may also be employed in various other applications.

LIST OF REFERENCE SIGNS AND ABBREVIATIONS

100 sample support plate
101 sample recipient site
102 interstitial area
103 laser
104 laser beam
105 beam spot
151 cell
153 droplet
154 glass slide
155 arrow
156 hydrophobic area
157 droplet
161 capillary
162 arrow
163 bulk liquid
164, 165 droplet
172 filled site
173 pipette
181 filled site
182 support
191 substrate surface
192 coating
193 filled site
194 cell
D1 periodicity
D2 centerline spacing
x first direction
y second direction
Int intensity
a.u. arbitrary units
m/z mass/charge ratio ATP adenosine triphosphate
GTP guanosine triphosphate
UDP uridine diphosphate
Glc glucose

The invention claimed is:

1. A method of sample preparation comprising:

providing a sample support plate comprising a substrate with a substantially flat surface, a plurality of spatially separated sample recipient sites being arranged on said surface, said sample recipient sites being mutually separated by areas that have a different wettability than said sample recipient sites, the sample recipient sites being arranged in a plurality of rows, each row consisting of a plurality of sample recipient sites whose centers are regularly spaced along a first direction with a predetermined periodicity, the rows being regularly spaced along a second direction perpendicular to said first direction with a predetermined centerline distance, each sample recipient site having a minimum lateral dimension and a maximum lateral dimension, the maximum lateral dimension being less than or equal to 200 μm, the periodicity along the first direction and the centerline distance along the second direction being such that each sample recipient site has a next-neighbor recipient site within an edge distance that is less than or equal to three times said minimum lateral dimension;

distributing a bulk liquid containing the sample onto said sample support plate in such a manner that the bulk liquid, after it has been distributed onto the sample support plate, splits into discrete droplets located at the sample recipient sites.

2. The method of claim 1, wherein the bulk liquid is a cell suspension.

3. The method of claim 1, wherein the sample is applied by continuously moving an application device relative to the surface of the sample support plate, the application device acting to continuously distribute the bulk liquid over the surface.

4. The method of claim 1, wherein the sample recipient sites form an array having a generally rectangular shape with two parallel longitudinal array edges and two parallel transverse array edges, wherein each row of sample recipient sites extends in a first direction that is parallel to the longitudinal array edges, and wherein adjacent rows are shifted with respect to one another along the first direction.

5. The method of claim 1, wherein adjacent rows are shifted with respect to one another along the first direction by half of said periodicity.

6. The method of claim 1, wherein the sample recipient sites form an array having a generally rectangular shape with two parallel longitudinal array edges and two parallel transverse array edges, wherein each row of sample recipient sites is inclined relative to the longitudinal array edges by an angle that is different from 0° and 90°, the orientation of the rows being such that, if a straight line is drawn parallel to said longitudinal array edges and at an arbitrary position along said transverse array edges within said array, there are always a plurality of sample recipient sites which are cut by said straight line.

7. The method of claim 1, further comprising, before or after the step of distributing the bulk liquid containing the sample onto said sample support plate, a step of applying a MALDI matrix to the sample recipient sites.

8. A method of preparing a plurality of samples on a sample support plate, each sample comprising a first and a second reagent, the method comprising:

providing a sample support plate comprising a substrate with a substantially flat surface, a plurality of spatially separated sample recipient sites being arranged on said surface, said sample recipient sites being mutually separated by areas that have a different wettability than said sample recipient sites, the sample recipient sites being arranged in a plurality of rows, each row consisting of a plurality of sample recipient sites whose centers are regularly spaced along a first direction with a predetermined periodicity, the rows being regularly spaced along a second direction perpendicular to said first direction with a predetermined centerline distance, each sample recipient site having a minimum lateral dimension and a maximum lateral dimension, the maximum lateral dimension being less than or equal to 200 μm, the periodicity along the first direction and the centerline distance along the second direction being such that each sample recipient site has a next-neighbor recipient site within an edge distance that is less than or equal to three times said minimum lateral dimension;

distributing first reagents to the sample support plate in parallel by simultaneously moving a plurality of application devices relative to the surface of the sample support plate along the first direction while dispensing the first reagents from the application devices;

distributing second reagents to the sample support plate in parallel by simultaneously moving a plurality of application devices relative to the surface of the sample support plate along the second direction while dispensing the second reagents from the application devices, and wherein the first and/or second reagents are distributed to the sample support plate as a bulk liquid in such a manner that the bulk liquid, after it has been distributed onto the sample support plate, splits into discrete droplets located at the sample recipient sites.

9. The method of claim 8, wherein at least one of the first and second reagents is a cell suspension.

10. The method of claim 8, wherein the method further comprises distributing cells onto the sample recipient sites.

* * * * *